US005415285A

United States Patent [19]

Reimers

[11] Patent Number: 5,415,285

[45] Date of Patent: May 16, 1995

[54] SOFT SIDED GOLF BAG WITH QUICK ACTION INTEGRAL STAND

[76] Inventor: Eric W. Reimers, 1235 Starwood, Missoula, Mont. 59802

[21] Appl. No.: 117,300

[22] Filed: Sep. 7, 1993

[51] Int. Cl.[6] ..... A63B 55/00; A63B 55/10

[52] U.S. Cl. ..... 206/315.7; 206/315.3; 206/315.8; 248/96

[58] Field of Search ..... 248/96; 206/315.3, 315.6, 206/315.8

[56] References Cited

U.S. PATENT DOCUMENTS

| | | | |
|---|---|---|---|
| 1,404,559 | 1/1922 | Watrous | 248/96 |
| 1,578,910 | 3/1926 | Nidle | 248/96 |
| 1,727,612 | 9/1929 | Lescher | 248/96 |
| 1,757,471 | 5/1930 | Platt | 248/96 |
| 1,882,785 | 10/1932 | Doughty | 248/96 |
| 1,924,182 | 8/1933 | Fritz | 206/315.7 X |
| 1,961,454 | 6/1934 | Reichhart | 248/96 |
| 1,978,230 | 10/1934 | Schutes | 248/96 |
| 2,186,491 | 1/1940 | Meyer | 206/315.7 |
| 2,283,412 | 5/1942 | Bright | 248/96 X |
| 2,449,171 | 9/1948 | Matthews | 248/96 |
| 4,778,136 | 10/1988 | Reimers | 206/315.7 X |
| 4,798,357 | 1/1989 | Cho | 206/315.7 X |
| 4,834,235 | 5/1989 | Socheim et al. | 206/315.8 X |
| 4,844,253 | 7/1989 | Reimers | 206/315.6 |
| 4,949,844 | 8/1990 | Yang | 206/315.7 |
| 5,036,974 | 8/1991 | Ross, Jr. | 206/315.7 |
| 5,042,654 | 8/1991 | Jones | 206/315.7 X |
| 5,048,777 | 9/1991 | Quellais et al. | 206/315.7 X |
| 5,074,577 | 12/1991 | Kim | 249/96 X |
| 5,096,148 | 3/1992 | Quellais et al. | 206/315.7 X |
| 5,147,089 | 9/1992 | Anderson | 206/315.7 X |
| 5,152,483 | 10/1992 | Maeng | 206/315.7 X |
| 5,154,371 | 10/1992 | Suk | 206/315.7 X |
| 5,178,273 | 1/1993 | Igarashi | 206/315.7 |
| 5,209,350 | 5/1993 | Maeng | 206/315.7 |
| 5,236,085 | 8/1993 | Quellacs | 206/315.7 |

FOREIGN PATENT DOCUMENTS

| | | | |
|---|---|---|---|
| 483857 | 6/1952 | Canada | 248/96 |
| 155266 | 3/1921 | United Kingdom | 206/315.6 |
| 398550 | 9/1933 | United Kingdom | 206/315.6 |
| 407324 | 3/1934 | United Kingdom | 206/315.6 |

*Primary Examiner*—Sue A. Weaver

*Attorney, Agent, or Firm*—Michael J. Huges; Bradley T. Sako

[57] ABSTRACT

A soft sided golf bag with a quick action integral stand (10) is provided to operate intermediate a stand mode and a storage mode. The stand assembly (14) is secured to the bag assembly at a top pivot assembly (40) and a bottom pivot assembly (44) and includes a leg member assembly (38) and a connecting rod assembly (42). The single linear connecting rod (98) transfers force from a rocker plate (114) on the bottom pivot (44) to an associated pair of pivot connectors (54) which rotate within a "V" block (60) of the top pivot to rotate the leg members (45) intermediate the modes. The golf bag (10) is characterized by single point connection for each leg member (45), rapid activation and "hands free activation.

20 Claims, 8 Drawing Sheets

SOFT SIDED GOLF BAG WITH QUICK ACTION INTEGRAL STAND

TECHNICAL FIELD

The present invention relates generally to sporting goods and golfing equipment and more particularly to golf bags having a stand mechanism to allow them to be supported off the ground. The preferred embodiment of the present invention is a golf bag characterized by having soft sides which can conform to the body of the user and having a quick action stand mechanism which is easily actuated by the user without direct contact. The mechanism uses a push-type connecting rod in a light weight structure to extend the legs to a stand made when desired, or retract them to a default storage mode. The invention is intended for use by golfers who prefer to carry a golf bag, rather than utilize a cart, and who wish to avoid the difficulties associated with bending down near the ground to pick up the bag or to retrieve clubs.

DESCRIPTION OF THE PRIOR ART

Golf bags have been an area of substantial innovation throughout the 20th Century. Golfers are, by their nature, innovative and demanding. Golfers are constantly changing their swing and equipment in order to attempt to derive the maximum enjoyment from the game. One area which has been the subject of a great deal of development has been in the method of carrying the clubs and equipment with the golfer during the round of golf.

For a large percentage of golfers, one of the great advantages of the game is that it provides an opportunity for exercise and also provides a quiet setting. For these types of golfers, particularly, the concept of utilizing a powered cart to transport the clubs is anathema. The purist prefers to the carry the clubs in a bag slung over the shoulder when moving from shot to shot.

Even the purists, however, do not always enjoy the simplest form of the golf bag, which is essentially a tube having one closed end and a strap. One common complaint with the simple carry bag is that it can be physically demanding on the player to constantly bend or stoop to place the bag on the ground or to pick it up when it is time to move to a new location. Further, when the bag is constantly being placed on the ground, it is subject to getting dirty and wet. This is not only unsightly, but can result in the dirt or moisture being transferred to the golfer's clothes or to other undesirable locations, such as the trunk of the car.

For this reason, one of the primary areas of innovation is in the field of golf bags having stand mechanisms which allow the open end of the bag to be supported above the ground. This not only provides for easier placement and retrieval of the bag but also provides for improved ease of club selection and better conditions for keeping the equipment clean and esthetically pleasing. The height off the ground at which the top of the bag is maintained (and the corresponding angle of inclination of the golf bags) during the stand mode, as opposed to the carry/storage modes, has varied widely, as have the nature of the mechanisms utilized to prop the bag up in an upright position.

One of the most successful golf bags, having an integral stand mechanism, has been the inventor's own invention which is shown and described in U.S. Pat. No. 4,778,136. This innovative structure, which has been commercialized in the Eclipse® golf bag of Sun Mountain Sports, Inc. of Missoula, Mont., is characterized by a self-actuating stand mechanism which is actuated in conjunction with the carrying strap so that when pressure is released on the carrying strap the legs move outward away from the bag to provide a stand mode with a tripod support. The self-actuating stand mechanism, among other unique features, has made the Eclipse® golf bag exceedingly popular.

Numerous other attempts have also been made to provide golf bags having stand mechanisms which allow the open end, or collar portion of the bag, to be supported above the ground. Some of these have been mechanisms which require the user to hand activate the leg actuating mechanism in such a manner that the legs are caused to extend outward from the bag and provide the support. Examples of this type of leg mechanism are found in U.S. Pat. No. 4,949,844, issued to F. Yang; U.S. Pat. No. 5,048,777, issued to J. Quellais; and U.S. Pat. No. 5,096,148, issued to J. Quellais and B. Gautherot.

Other methods have involved various types of golf bags which are "self-actuated" in that the activity of placing them on the ground in some manner causes the stand mechanism to be actuated so as to provide the support. In addition to the Eclipse® bag described above, and the related commercial products of the Highlander Golf Company of South Dakota, this has been an area in which a substantial number of United States patents have issued. Among these are U.S. Pat. No. 5,036,974, issued to C. Ross Jr. and U.S. Pat. No. 5,042,654, issued to G. Jones. These two patents illustrate a style of activation in which a portion of the activation mechanism extends downwardly beyond the bottom of the bag (or a portion thereof) and the force of setting the bag on the ground pushes upward on this activation mechanism to urge the rotation of the legs outward from the bag and to go from the carry mode to the stand mode.

A modification of the same sort of stand mechanism is illustrated in U.S. Pat. No. 5,152,483, issued to S. Maeng. The stand mechanism illustrated in the Maeng patent is a variation on the downward extension method of activation but it utilizes a pivoting bottom portion to force a pair of spring members upward, which spring members then act to force the legs outward.

Although a large number of different varieties of golf bag stand mechanisms have been produced and introduced, substantial room remains for innovation in the field. For example, although the Eclipse® bag described above has received very wide acceptance, a percentage of golfers object to the semi-rigid nature of the bag tube itself. That is, some golfers prefer a structure in which the tube portion of the bag is soft (known as a soft-sided bag) and can conform to the sides, back or other portion of the user, against which it would rest during carrying. Although some of the type of stands which have been introduced in the prior art are usable with soft sided bags, this is not always the case.

Other areas in which a desire for improvement exists are in simplifying the mechanism utilized to provide for golf bag stands, and in minimizing the travel distance of the various parts. For example, stand mechanisms utilizing expansion spring structures, such as shown in Maeng, Johns and Ross, require that the activation mechanism structure, as well as the legs, extend outward from the bag in the stand mode. This precludes the option of enclosing the activation mechanism within the bag itself, or a pocket portion thereof. This can detract from the potential locations in which the bag may be placed in stand mode and can also detract from the esthetic appearance of the product.

Furthermore, it is desirable to minimize the fatigue factors on the parts which are required to move and/or interact and to maximize the interchangeability and replaceability of the structure. These desirable goals add to the life of the product by causing the parts to be replaceable in an efficient manner as well as providing for other parts which can be made to be particularly resistant to breakage and wear.

Another common difficulty experienced with prior art stand mechanisms, particularly those which are ground contact actuated, is that the ends of the legs can become caught in foliage or catch against the ground itself. This fouling of the operation can hinder proper transition from the storage to the stand modes and is often frustrating and inconvenient. In the case of inveterate golfers, this can even result in the bag tipping over, with potential damage.

Self actuated and ground actuated stand mechanisms have also frequently been characterized as "slow" in operation. This is due to the extended rotational lever arms and the length of travel of the various elements. Quick action mechanisms are desirable in that they allow more rapid set up and retrieval and minimize intermediate difficulties. However, prior art attempts at quick action have not been notably successful.

As is clear from the wide variety of innovations which has been provided in the golf bag art, a continuing need for improvement and innovation exists in this field. Various prior art methods have accomplished some desirable goals, but other goals remain unmet, particularly in combination. For this and other reasons, there remains a need for an improved soft sided golf bag with a quick action integral stand mechanism such as presented in the current invention.

DISCLOSURE OF INVENTION

Accordingly, it is an object of the present invention to provide an integral stand mechanism for a golf bag which is particularly well adapted for use with a soft sided bag.

It is another object of the present invention to provide a stand mechanism wherein a substantial portion of the mechanism may be retained in a pocket or extended portion of the bag and need not extend outward.

It is a further object of the present invention to provide an integral stand mechanism for a golf bag which is simple and elegant in operation and requires a minimal travel distance for the operative parts.

It is yet another object of the present invention to provide for easy replacement of those parts which are subject to substantial stress.

It is still further object of the invention to provide a quick action stand mechanism.

It is still another object of the present invention to provide a stand mechanism which can be actuated or not, as desired, when the bag is placed on the ground, depending upon the orientation.

It is a further object to provide a stand mechanism which minimizes inhibition of transition from mode to mode and also minimizes leg fouling.

The preferred embodiment of the present invention is a soft sided golf bag with a quick action integral stand in the form of a stand mechanism assembly and an associated soft sided golf bag. The preferred embodiment is intended to provide a method for supporting the golfer's clubs in an accessible and relatively upright position while providing maximum comfort for carrying. The preferred embodiment includes a bag assembly which is, in most ways, a conventional soft sided golf bag, and a stand assembly, which, while superficially resembling prior art mechanisms, is improved both as to structure and elegance of operation. The stand assembly includes a pair of mirror image leg members commonly connected to a top pivot subassembly situated on the front of the golf bag between the top and the midpoint. The preferred bag assembly includes a base member to which a foot pivot subassembly of the stand assembly is attached. The preferred embodiment is operated by the pivoting of the foot pivot subassembly to drive a connecting rod subassembly and a top pivot subassembly in a manner which forces the leg members outward in order to form, with the foot pivot subassembly and a portion of the base member, a stable tripod. An elastic retractor cord is provided in order to urge the legs inward against the tube portion of the bag assembly when the foot pivot is not activated. The connecting rod subassembly and the elastic cord are adapted to lie next to the original tube portion of the bag such that, if desired, they may be enclosed within a pocket or sheath attached to the bag or actually enclosed within a portion of the bag itself.

An advantage of the present invention is that it may be readily utilized with otherwise soft sided golf bags, and may be comfortably carried by the user.

Another advantage of the present invention is that it does not require that the leg mechanism be operated by hand or attached to the strap mechanism.

Yet another advantage of the present invention is that the stand mechanism does not protrude unduly from the bag structure so that storage of the integral bag and stand is easily accomplished.

Another advantage of this invention is that it utilizes a quick action mechanism with a relatively short lever stroke to provide leg position transitions.

A further advantage of the present invention is that the bag may be placed on a surface without automatically converting from carry mode to stand mode, if this is desired.

Yet another advantage of the invention is that the legs, while long enough to provide a tripod with the bag top well above the ground for ease of use, are short enough to avoid ground and foliage contact during mode transition, thus minimize failed transitions.

A still further advantage of the present invention is that the default configuration is the compact storage mode, thus facilitating transport and storage.

Still another advantage of the present invention is that it is easily converted from carry mode to stand mode, when desired, and automatically converts from stand mode to carry mode when it is lifted from the surface.

Still another advantage of the present invention is that components which are sturdily constructed and modularly formed so that easy replacement and repair may be accomplished if needed.

Yet another advantage of the present invention is that it utilizes light weight spring cord material to provide the retraction force, thus providing a weight advantage over structures utilizing metal springs.

These and other objects and advantages of the present invention will become clear to those skilled in the art upon review of the following specification, the accompanying drawings and the appended claims.

BEST MODE FOR CARRYING OUT THE INVENTION

The best presently known mode for carrying out the present invention is a soft sided golf bag with a quick action integral stand in which the inventive integral stand mechanism is combined with a conventional or preexisting bag assembly. The preferred embodiment is intended to be utilized by golfers who prefer to carry their own clubs, but who also prefer the convenience of having the clubs accessible at a level well above the ground. These golfers and also prefer to avoid the inconvenience and discomfort of bending over to pick up the bag or to adjust various mechanisms.

Figure 1:
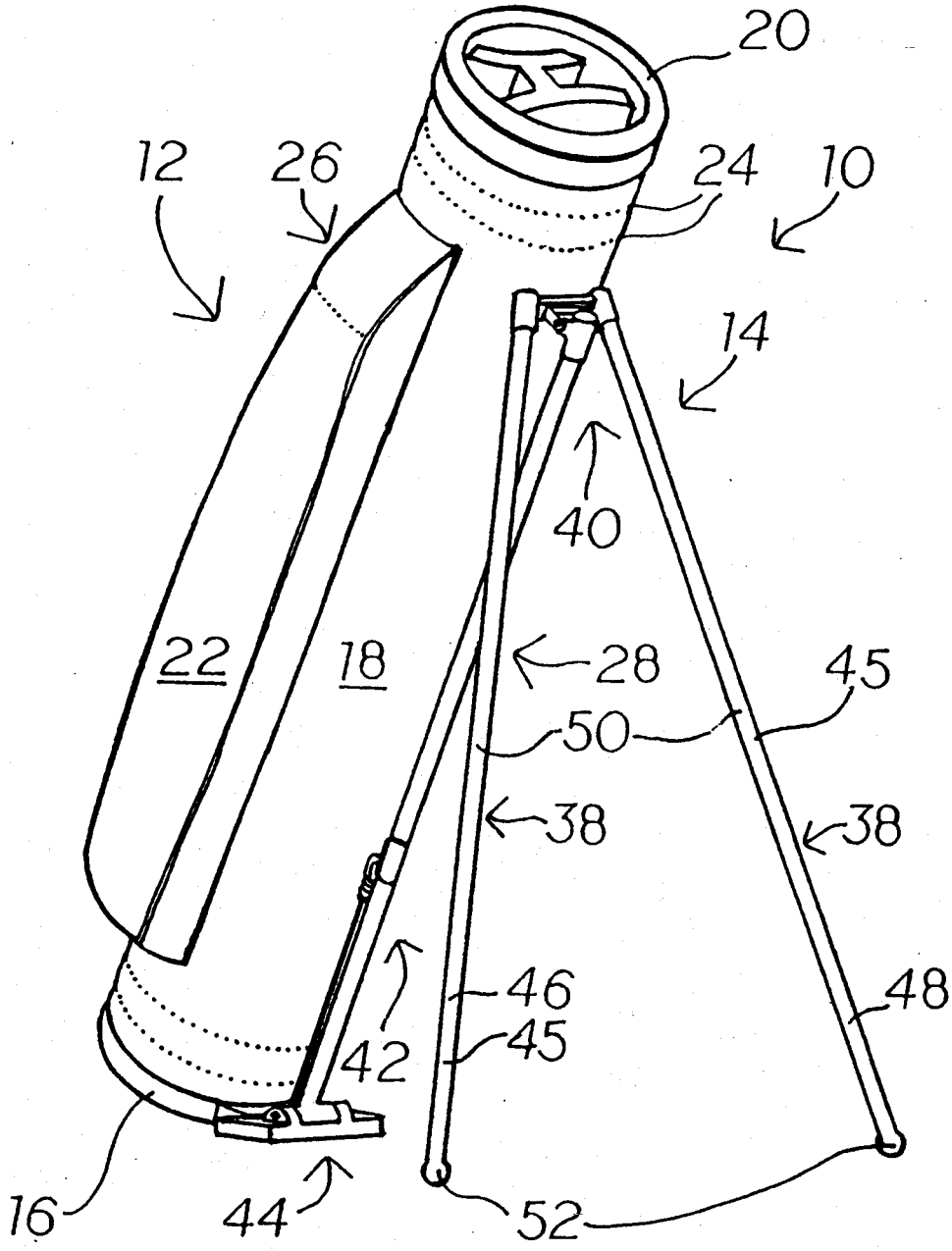
FIG. 1 is a perspective view of a soft sided golf bag with integral stand according to the preferred embodiment of the present invention, shown in stand mode.
Figure 2:
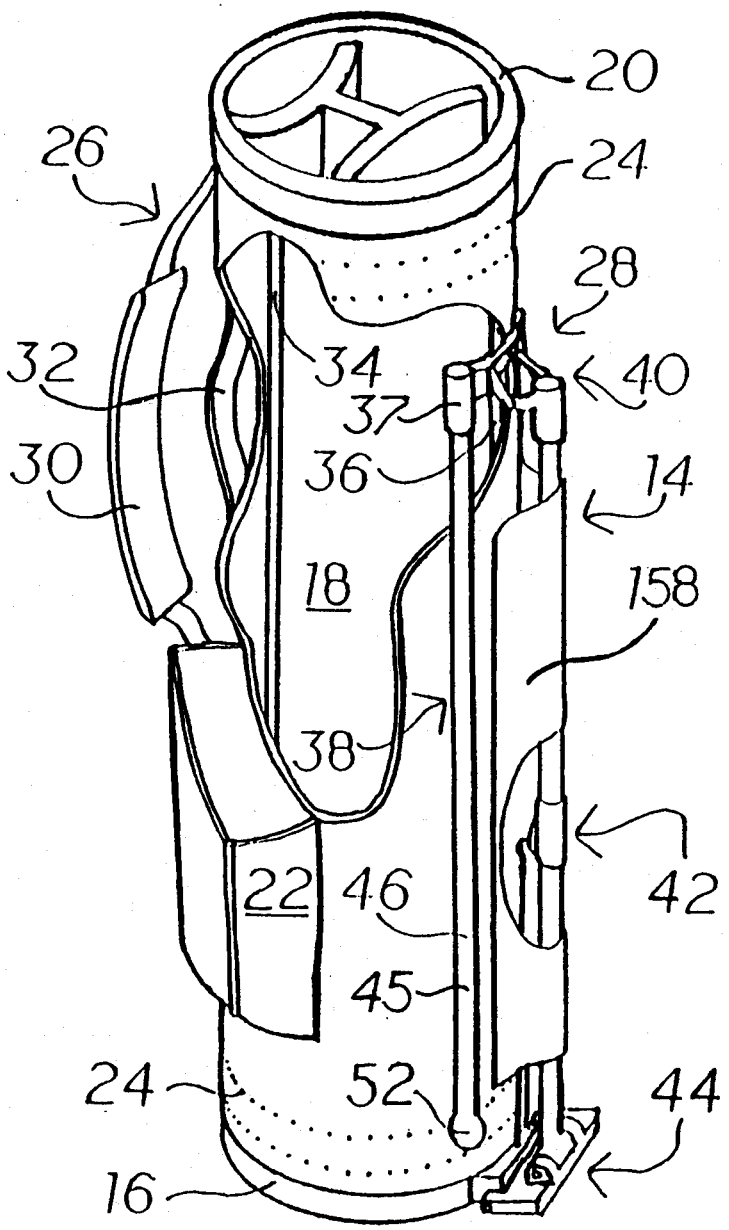
FIG. 2 is a partially cut-away perspective view of the preferred embodiment, shown in storage mode.

The preferred embodiment of the present invention is a soft sided golf bag with a quick action integral stand, together forming a system which is illustrated in perspective views in FIGS. 1 and 2 and is designated by the general reference character 10. The preferred embodiment is adapted to be utilized on the golf course, when not being carried, in a stand mode which is illustrated in FIG. 1. The stand mode, also referred to as the extended mode, is the orientation when the bag is placed on the surface with the intent of utilizing the stand. The storage mode, also referred to as the carry mode or the retracted mode, is illustrated in FIG. 2 and is utilized during storage, carrying and in certain conditions when the bag is placed upon the ground (or in a golf cart) when it is not desirable to have the legs extended. The mechanisms of the assembly 10 are adapted to provide stable modes and efficient transitions between the modes.

As is shown in FIGS. 1 and 2, particularly, the soft sided golf bag with quick action integral stand system includes a bag assembly 12 and a stand assembly 14. The bag assembly 12 is substantially conventional in nature and it is intended that the stand assembly 14 may be utilized on any of a wide variety of preexisting golf bag structures. For the purposes of the present discussion, the bag assembly 12 is presumed to be a soft sided conventional golf bag, with the particular bag chosen being the FRONT 9 TM golf bag manufactured and sold by Sun Mountain Sports, Inc. of Missoula, Mont.

The preferred bag assembly 12 is an elongated tubular structure, being hollow in the interior for the purpose of receiving golf clubs. The preferred bag assembly includes a rigid base member 16, a pliable tube portion 18 and a rigid collar member 20. The exterior of the tube portion 18 is provided with pockets 22 and other accessories or elements which are held in position by stitching 24. The stitching may also form a portion of the manner in which the base 16 and collar 20 are secured to the tube 18.

Figure 8:
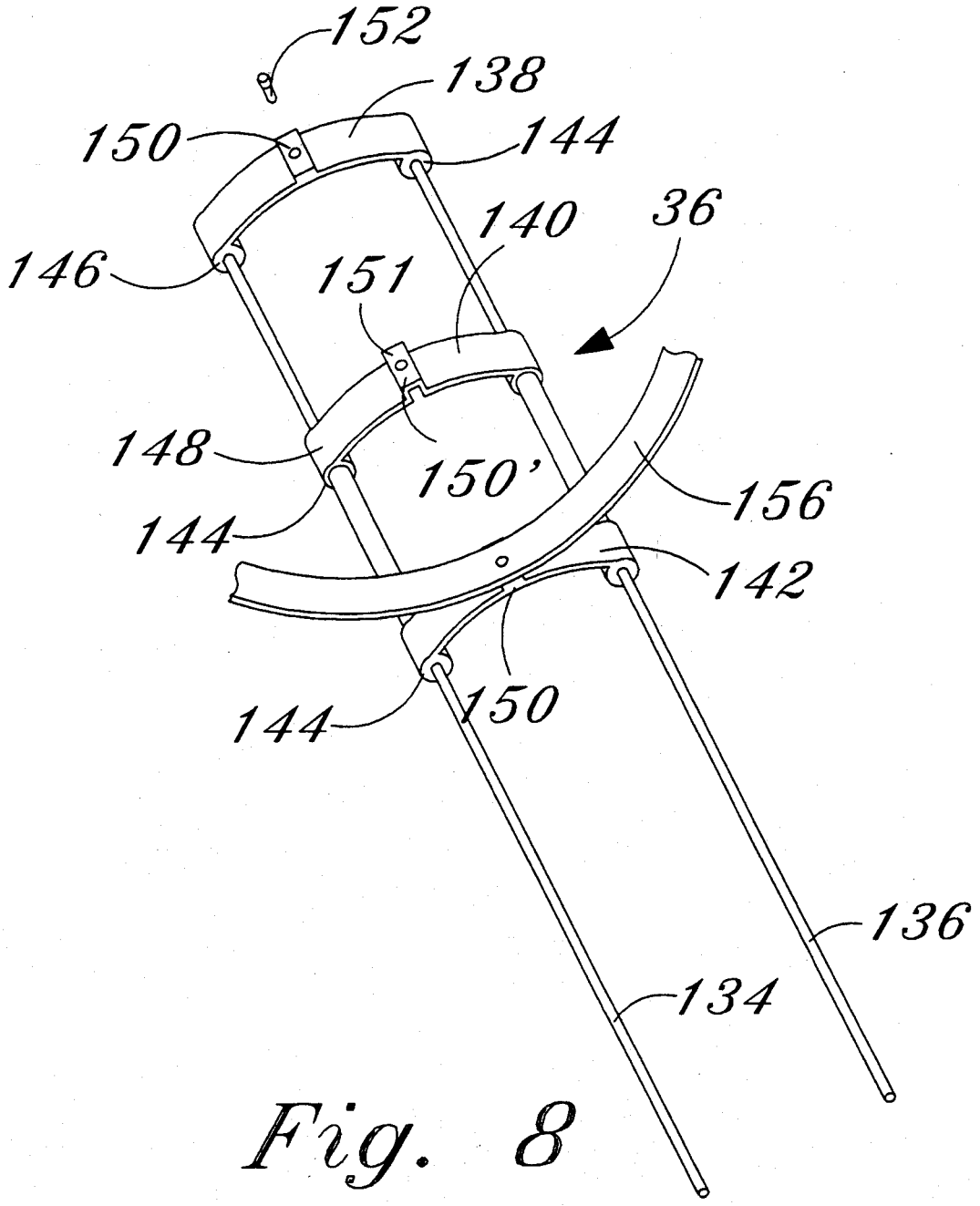
FIG. 8 is a perspective view of a front buttress subassembly.

The bag assembly 12 is, for the purposes of convenience of description, designated as having a rear portion 26, also known as a "spine", and a front portion 28. Along the rear portion 26 are placed a conventional carrying strap 30 and an optional carrying handle 32. The carrying strap 30 and the handle 32 are provided such that the bag may be easily picked up and carried from one position to another. The stand assembly 14 is attached to the front portion Even though the bag assembly 12 is soft sided, that is, it is pliable so that it will conform to the contours of the body of the person carrying the bag 10, it is desirable to maintain some longitudinal rigidity in order to properly contain the golf clubs. It is not desirable for the bag to collapse too much, for in those circumstances an undesirable extent of the club shafts will be exposed and optimum efficiency will not obtain. For this reason, the bag assembly 12 is provided with a spine dowel 34 which extends along the spine 26 from the base member 16 to the tube portion 18. The spine dowel 34 maintains a degree of rigidity. Longitudinal 4 support for the front portion 28 is provided by a front buttress subassembly 36. In the case of a conventional bag assembly 12, as shown in FIGS. 1 and 2, this may be a simple front stay member 37 which extends along the front interior 8 of the tube portion 18. As shown in FIG. 8, and discussed in connection therewith, a more elaborate front buttress subassembly 36 may be desirable.

In some constructions of relatively soft-sided bags, such as is provided in the Sun Mountain Sports, Inc., ANACART ® brand golf bag, shown and described in U.S. Pat. No. 4,796,752, a plurality of support rods are utilized instead of single spine dowel 34. In the Front 9 TM type bag assembly 12 shown in FIGS. 1 and 2, only one actual dowel 34 is provided, the front stay 37 being a less rigid member which is typically an elongated flat plate. The front stay 37 is useful for general bag rigidity and also provides the support for a portion of the stand assembly 14. The more rigid front buttress subassembly 36, illustrated in FIG. 8 is preferred for newly constructed bags, since it provides better support.

The stand assembly 14 constitutes the primary locus of the inventive aspects of the present invention 10. The stand assembly 14 may be seen in FIGS. 1 and 2, in particular, to include four subassemblies. These are a leg member subassembly 38, a top pivot subassembly 40, a connecting rod subassembly 42 and a foot pivot subassembly 44. These subassemblies work together to create the operational stand assembly 14 for the preferred embodiment 10.

The leg member subassembly 38 includes a pair of mirror image leg members 45, these being a left leg member 46 and a right leg member 48. Each of the leg members 45 includes a rod portion 50, preferably a reasonably rigid fiber composite or aluminum tube, such as the ones found on the Sun Mountain Sports, Inc. ECLIPSE ® golf bag. The lower end of each of the leg members 45 terminates in a tip ball 52 which provides a good support point for the leg members 45 on a wide variety of surfaces. The upper end of each of the leg members 45, where it interfaces with the top pivot subassembly 40, includes a pivot connector 54 having a rod detent 56 for receiving a pivot post portion 58 of the L-shaped pivot connector 54. A securing screw 59 holds the pivot post portion 58 in place within the rod detent 56 in the leg member 45. This arrangement creates a single force transfer point for providing rotational force to each leg member 45. The pivot connector 54 also forms a portion of the top pivot subassembly 40 and is more fully discussed below.

Figure 3:
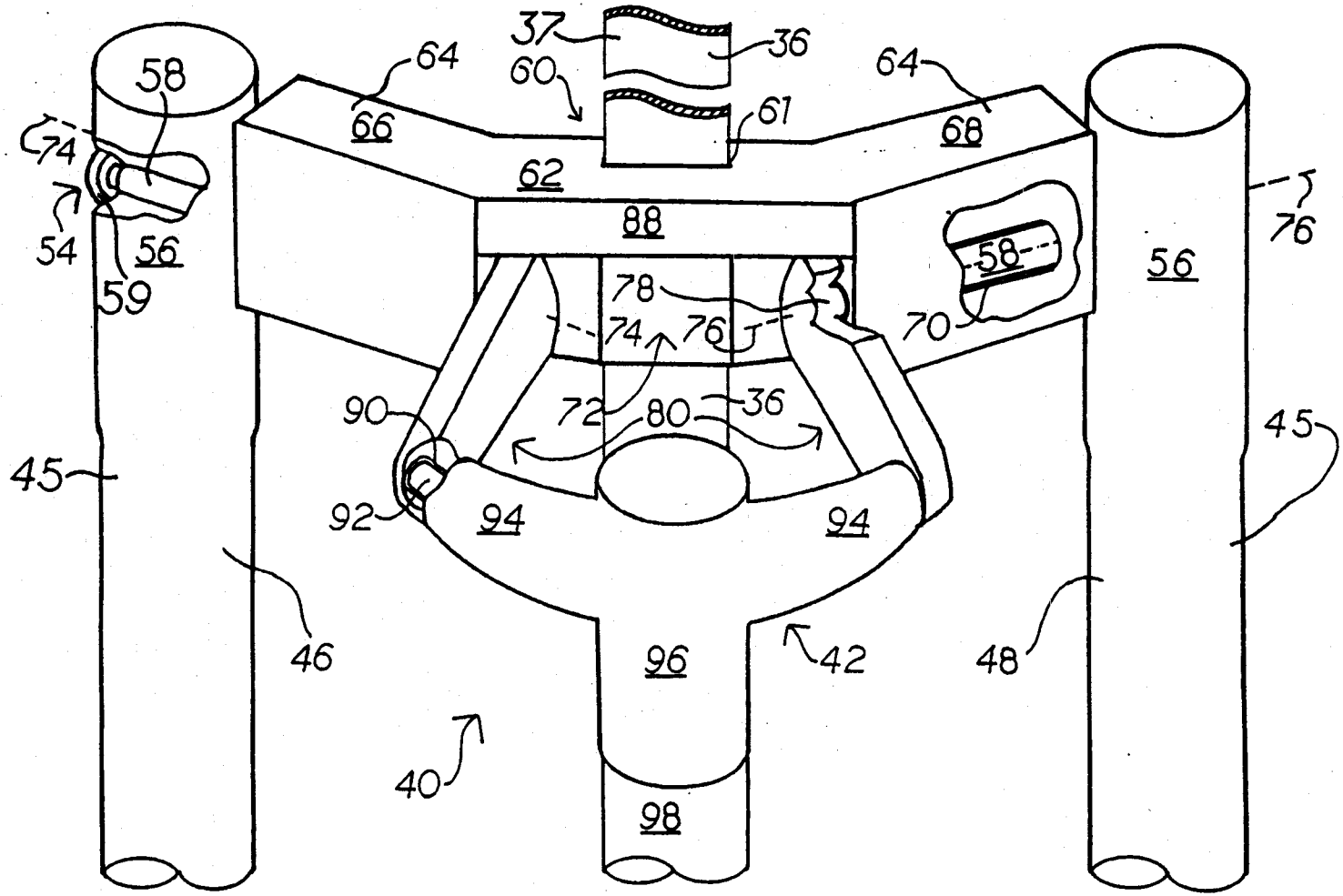
FIG. 3 is a front perspective view of the top pivot subassembly portion of the stand mechanism, shown in storage mode.
Figure 4:
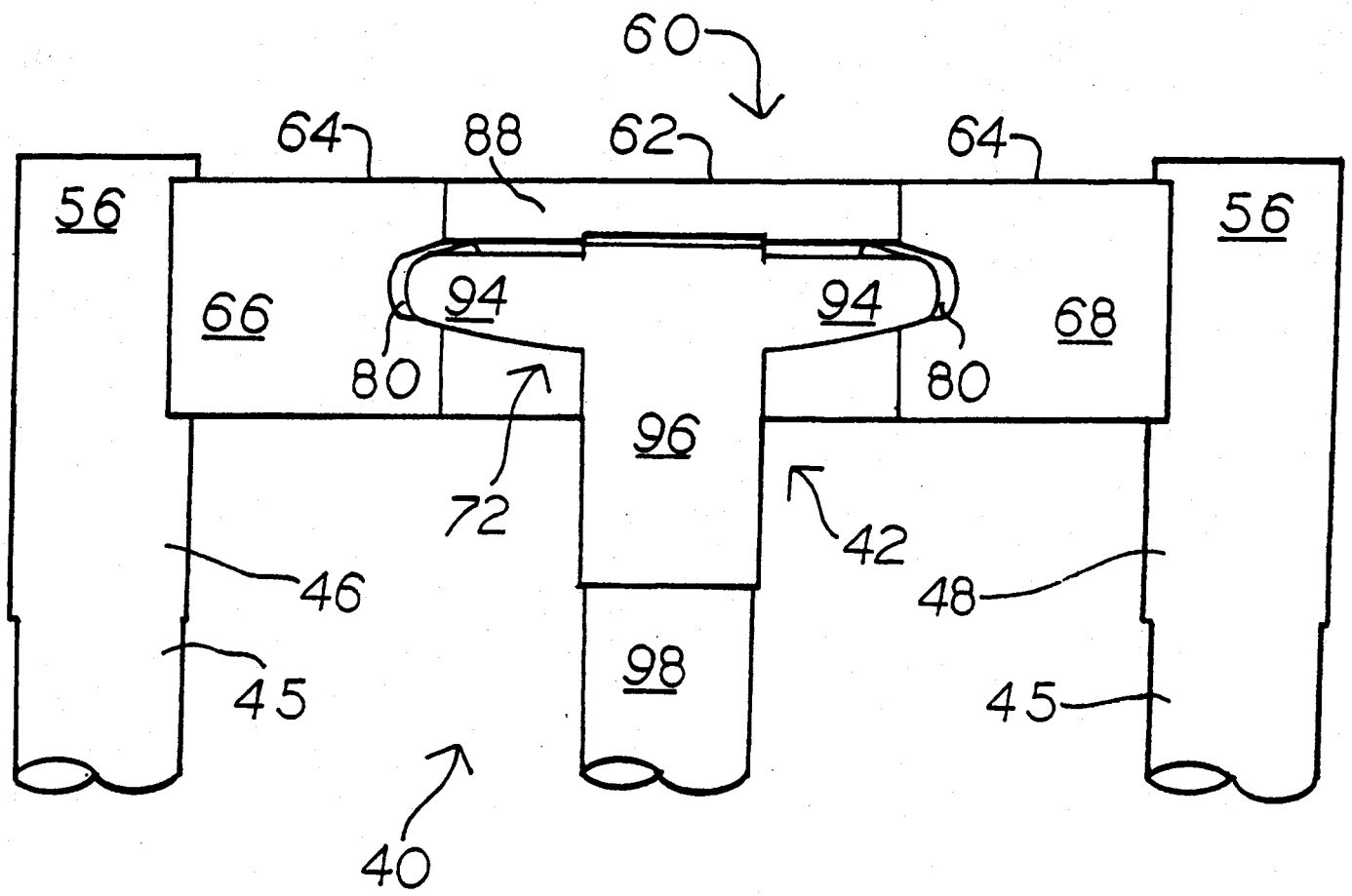
FIG. 4 is a view of the top pivot subassembly, partially cut away, shown in stand mode.

The top pivot subassembly 40 is particularly illustrated in FIGS. 3 and 4. In these illustrations, the interaction between the top pivot subassembly 40, the leg member subassembly 38 and the connecting rod subassembly 42 is illustrated. The top pivot subassembly 40 provides the mechanism by which the leg members 45 are caused to rotate between the retracted position of the storage mode (FIG. 2) to the extended orientation of the stand mode (FIG. 1), and vice versa.

The primary structural component of the top pivot subassembly 40 is a "V" block 60. The "V" block 60 is a strong rigid member which is securely attached to the front stay 36 in such a manner that the "V" block 60 is held in a firm constant orientation with respect to the base member 16 and the collar member 20. This attachment may include adhesives and/or mechanical fasteners. In the preferred embodiment 10 adapted to be secured to a simple front stay 37, the "V" block 60 includes a vertical slot 61 for slidably receiving the front stay 37. This secures the "V" block 60 in all directions other than vertical, and vertical capture may be accomplished by mechanical fasteners (screws or rivets) or adhesives.

The "V" block 60 further includes a central portion 62 and a pair of opposed wing portions 64 which are angled rearward from the sides of the central portion 62 at an angle of approximately twenty-five degrees to form a left wing portion 66 and a right wing portion 68. Each of the wing portions 64 is provided with a wing bore 70 (shown in the cut-away portion of FIG. 3) to receive therein the pivot post 58 of the associated leg member 45. The wing bore 70 extends completely through the interior of each of the wing portions 66 in order to provide access for the pivot post 58 to a front cavity 72 formed in the central portion 62 of the "V" block 60. The "V" block 60 is dimensioned such that the center of the central portion 62 and the distal ends of the wing portions 64 are oriented to be tangential to the curvature of the bag tube 18.

The orientation of the wing portion 64 with respect to the central portion 62, and particularly the orientation of the wing bores 70 with respect to the orientation of the central portion 62, provides for a left pivot axis 74 associated with the left wing 66 and left leg member 46 and a corresponding right pivot axis 76 which is associated with the right leg member 48 and right wing 68. The pivot axes are coplanar and need to be angled downward, since this orientation provides for good mechanical support and efficient mode transition for the leg members 45. In the preferred embodiment 10, for a bag tube 18 having a diameter of 20.5 cm (8 in), the pivot axes 72 and 76 are each at an angle of about 25° with respect to the central portion 62 (130° with respect to each other ). This angle of the associated pivot axes 74 and 76 provides a mechanism by which the leg members 45 are caused to rotate not only forward from the tube portion 18 but also to rotate outward such that the associated tip balls 52 are much further apart in the stand mode of FIG. 1 than they are in the storage mode of FIG. 2.

In the illustrations of FIG. 3 and 4, it may be seen that for each of the leg members 45, the pivot post portions 58 extends through the wing bore 70 and interfaces at an "L" joint 78 with an integral rocker arm portion 80. The pivot connector 54 is adapted to mate with the connecting rod subassembly 42 to provide the rotational force to the leg members 45 to provide mode transition. The "L" joint 78 is situated within the front cavity 72 of the central portion 62 of the "V" block 60. The pivot connectors 54, with the associated rocker arms 80, form a portion of the connecting rod subassembly 42, as well as a portion of the top pivot subassembly 40. The integral formation of the post portion 58 and the rocker arms 80 is such that there is no slippage. This means that when the rocker arms 80 move, the pivot post portion 58 must move or rotate therewith, thus causing the rotation of the leg members 45.

The rocker arms 80 are limited in the degree which they may rotate the pivot post portions 58 about the associated pivot axes 74 or 76 by a stop ledge 88 which is formed in the central portion 62 just above the front cavity 72. The stop ledge 88 prevents further rotation by preventing further movement of the rocker arm 80 about the associated axes in the rotational direction. The function of the positioning of the stop ledge 88 and of the sides of the rocker arm 80 is to cause the leg members 45 to rotate out to the preferred orientation for the stand mode illustrated in FIG. 1. In the preferred embodiment 10 the angle of the leg members 38 with respect to the major axis of the bag assembly 12 is selected to be about 45°. It has been found that this provides good tripod support to the golf bag with integral stand 10, in the stand mode.

The ends of the rocker arms 80 opposite the "L" joint 78 are provided with pivot/slide bores 90. The pivot/slide bores 90 are adapted to mate with a pair of sliding posts 92 which extend outward from opposing arm portions 94 of an (optionally curved) "T" connector 96 of the connecting rod subassembly 42. The sliding posts 92 extend outward from the end of the arm portions 94 for a distance greater than the thickness of the rocker arms 80 such that each sliding post 92 extends completely through the associated pivot/slide bore 90. Further, the pivot/slide bores 90 have a circular cross section and the sliding posts 92 also have a circular cross section such that the rocker arms 80 may both slide on and rotate about the associated sliding post 92.

The "T" connector 96 is adapted to be securely mounted to the top of a connecting rod 98. As is illustrated in the comparison of FIGS. 3 and 4, it is the upward motion of the connecting rod 98 which causes the desired rotation of the leg members 45 between the stand mode and the storage mode. As is shown in FIG. 3, the connecting rod 98 is in a down position and the associated rocker arms 80 extend downward from the "V" block 60. This results in a forced rotation of the pivot connectors 54 and the associated leg members 45 about the pivot axes 74 and 76 such that the legs are forced inward toward the storage position. In the storage position the leg members 45 may actually rest against the sides of the tube portion 18. The curvature shown for the "T" connector 96 is not critical to operation and any structure which supports the sliding posts 92 in the proper orientation is appropriate.

In the transition between the orientation of FIG. 3 and FIG. 4, it may be seen that the upward movement of the connecting rod 98 to the position of FIG. 4 causes corresponding motion in the attached components. In this case, the upward movement of the connecting rod 98 forces the sliding posts 92 downward, which in turn cause the distal ends of the rocker arms 80 to move upward and to rotate the associated pivot post portions 58. The motion of the sliding posts 92 induces lowered motion of the rocker arms 80, which causes the pivot post portions 58 to rotate about the associated pivot axes 74 and to cause the legs 45 to rotate outward to the position of the stand mode. Since only a linear upward movement of the distal ends of the rocker arms 80 is desired, the proximal ends of the rocker arms 80 rotate about the associated sliding posts 92. Further, each rocker arm 80 is permitted to slide axially along the sliding post 92 to prevent binding. The amount of rotation is limited by the upper surface of the proximal ends of the rocker arms 80 abutting against the stop ledge 88 of the "V" block 60. This condition obtains when the proper degree of exterior rotation is achieved.

Figure 5:
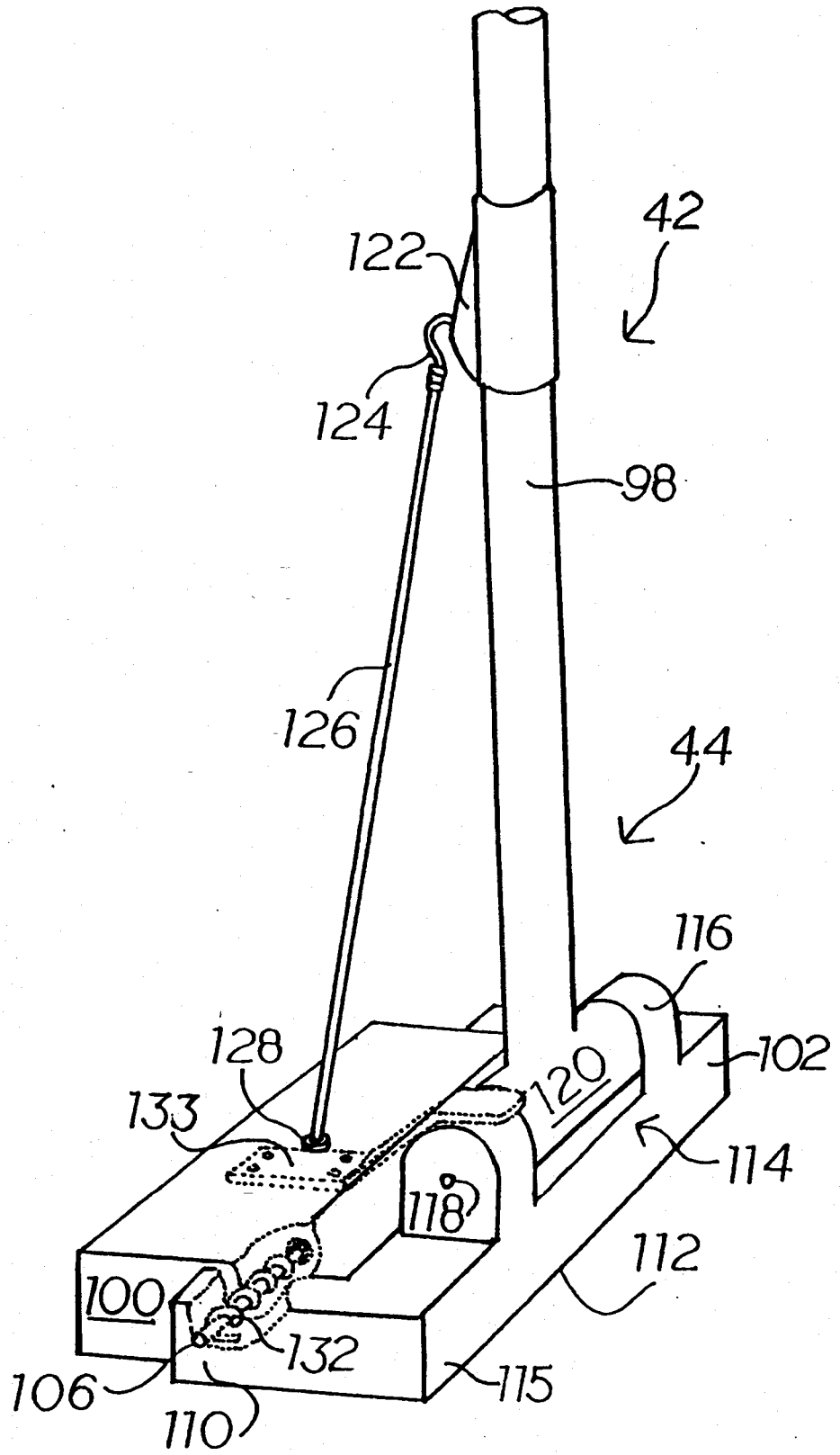
FIG. 5 is a front perspective view of the bottom pivot subassembly, shown in storage mode, and illustrating alternate tensioning and urging structures.
Figure 6:
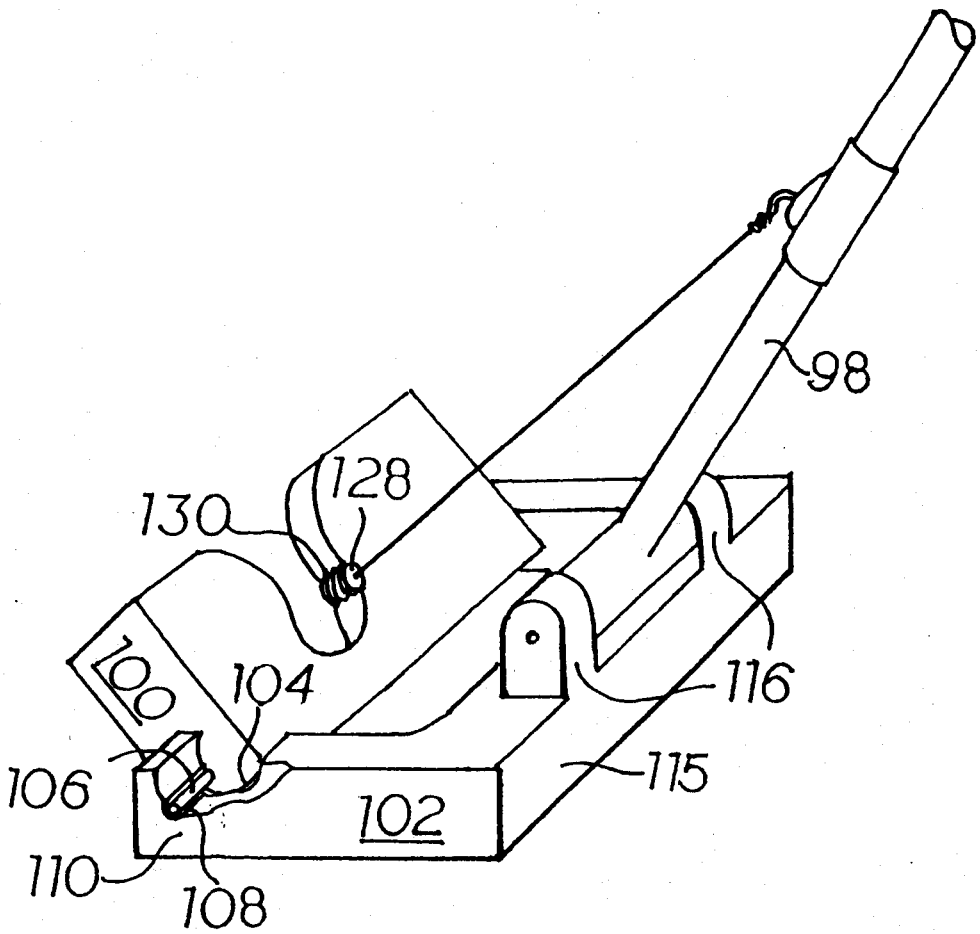
FIG. 6 is a partially cut-away view of the foot pivot subassembly, shown in stand mode.

The manner in which the upward and downward motion of the connecting rod 98 is achieved is by the relative motion of the foot pivot subassembly 44. This is illustrated in the depictions of the foot pivot subassembly 44 and the lower portion of the connecting rod subassembly 42 in FIGS. 5 and 6. FIG. 5 illustrates the storage mode, corresponding to FIGS. 2 and 3, while FIG. 6 illustrates the configuration of the foot pivot subassembly 44 in the stand mode, corresponding to FIGS. 1 and 4.

As may be seen in from illustrations of FIGS. 1, 2, 5 and 6, the foot pivot subassembly 44 includes a base block 100 which is attached to the base member 16 and a foot block 102 which is pivotally attached to the base block 100.

The base block 100 is a rigid member which is securely affixed to the base member 16 of the bag assembly 12. The base block 100 is curved on the side facing the base member 16 so as to provide good circumferential contact. In some preferred embodiments, the base block 100 may actually be a molded portion of the base member 16, while in the embodiment illustrated, the base block 100 is a separately formed portion which is then attached to the base member 16 by mechanical fasteners or a strong permanent adhesive. The side of the base block 100 which faces away from the bag assembly 12 is provided with a pivot contour 104 which allows spacing such that the foot block 102 may pivot in a limited arc about the base block 100. The connection between the base block and the foot block 102 is accomplished at a pair of pivot posts 106 situated on the sides of the base block 100 near the pivot contour 104. The pivot posts 106 are received in corresponding pivot bores 108 formed in protrusions extending from the foot block 102 to fit about the sides of the base block 100.

The foot block 102 further includes a bottom surface 112 of a rocker plate portion 114. The bottom surface 112 is the portion which will actually contact the ground and is intended to lie flat on the ground in the stand mode, although this is not essential for operation. It is also envisioned that embodiment in which only a front edge 115 of the rocker plate 114 will touch the ground. In the carry mode, the foot block will be overrotated such that only the distal front edge 115 of the bottom surface 112 contacts the ground. This preloads the stand actuation mechanism. 0f course, the bag may be heavy enough to force the bottom surface 112 against the ground in the stand mode. If this is the case, the legs will be slightly rotated outward (less than 5 degrees).

The rocker plate 114 portion of the foot block 102 includes a pair of hinge posts 116 which support a hinge pin 118 therebetween. A rocker "T" bar 120, which forms a portion of the connecting rod subassembly 42, is adapted to be mounted between the hinge posts 116 and to rotate on the hinge pin 118.

A hook receiver 122 is secured to or forms a part of the connecting rod 98 at a position displaced above the foot pivot subassembly 44. The hook receiver 122 is adapted to receive and retain the end of a hook 124, which forms the terminal end of an elastic cord 126. The other end of the elastic cord 126 is secured to an anchor nut 128 which is fastenable to the base block 100 at a threaded bore 130. The elastic cord 126, typically the type ordinarily referred to as a "bungee" cord, provides a continual downward force on the connecting rod subassembly 42. That is, when the force of the elastic cord 126 is not overcome by other forces, the connecting rod 98 will be urged downward, thus pushing the foot block 102 downward and pulling the rocker arms 80 downward such that the leg members 45 are drawn inward against the bag assembly 12.

The manner in which the foot pivot subassembly 44 functions is shown in the comparison of FIGS. 5 and 6. In the storage or carry mode of FIG. 5, no substantial external forces are applied to the foot pivot subassembly 44. In this case, the force of the elastic cord 126 acting to pull downward upon the connecting rod 98 by the action of the hook 124 in the hook receiver 122 (or alternate tensioning means), forces the rocker "T" bar 120 downward such that the rocker plate 114 rotates about the pivot posts 106 to a downward position. The extent of the downward rotation is limited by whichever first occurs of the legs 45 abutting against the tube portion 18 (preferred) or by one of the mechanisms in either the upper or the top pivot subassembly 40 or the foot pivot subassembly 44 abutting against another component so as to prevent further rotation.

Figure 7:
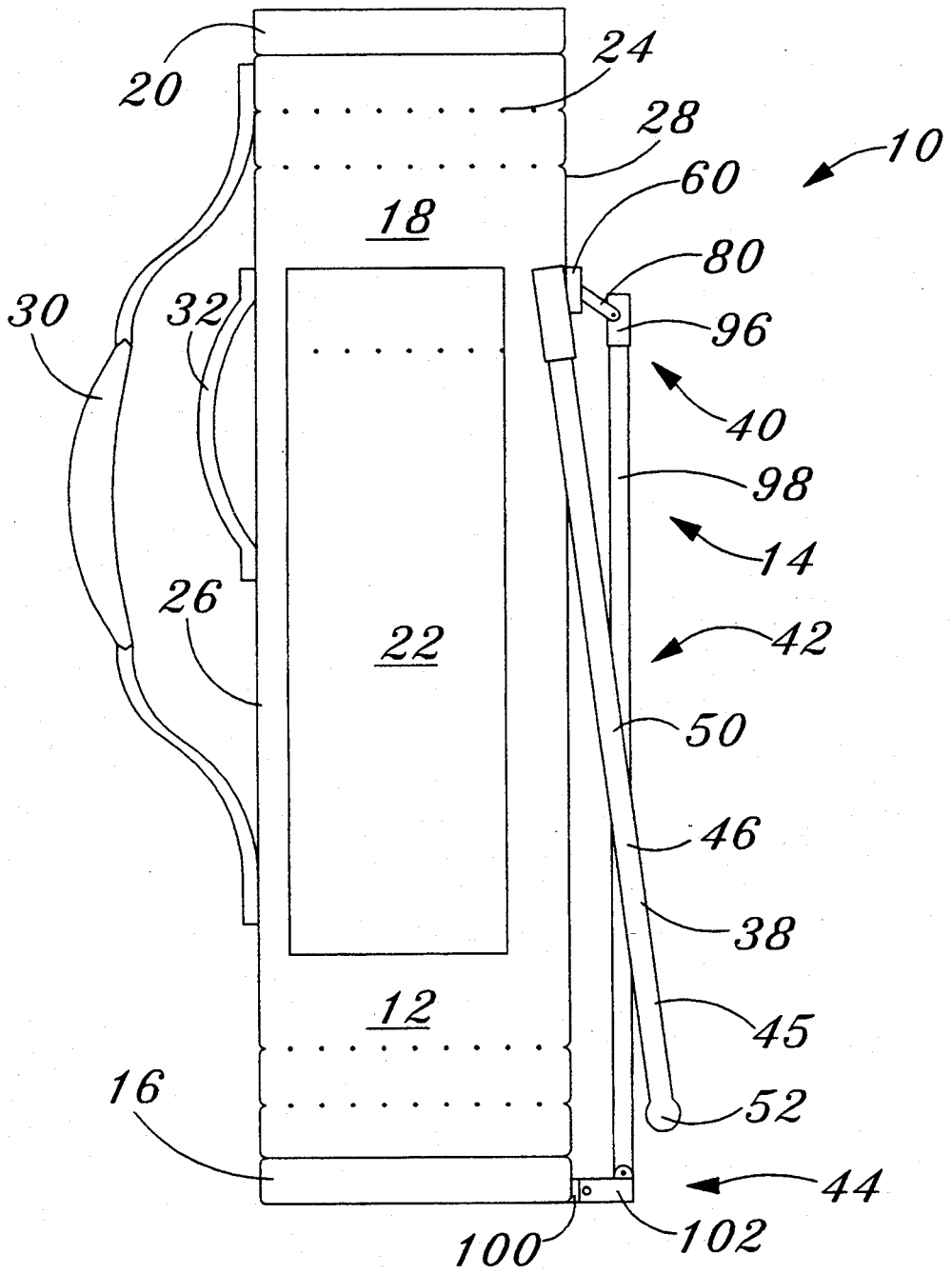
FIG. 7 is a side view of the preferred embodiment in an intermediate mode.

An alternate stop position occurs when the golf bag system 10 is placed in an intermediate mode where the bag 14 is set on the ground or a flat surface, but is not tipped forward. The configuration of the components is structured so that the alternate stop position mode configuration will occur with the bottom surface 112 being essentially coplanar with the bottom of the base block 100 and of the base member 16. This will cause the bag to be easy stood in an upright position on a flat surface, with an extended balancing base component so that it is easily to store the golf bag 10 on a flat surface, such as a garage or locker floor, or to stand the bag upright in a golf cart, should this usage be desired. The legs 44 will extend slightly outward in the intermediate mode, since the connecting rod 98 is prevented by the ground surface contact from reaching its lowest position. When the bag is picked up off the surface, the restraint is removed and the legs 45 will be further rotated to lie against the tube portion 18. If it is necessary to store the system with the legs 45 fully retracted,this may be accomplished by tilting the bag back slightly so the foot block 102 rotates downward. The intermediate mode is illustrated in FIG. 7.

When it is desired to set the bag upon the ground in such a manner that it will be utilized in the stand mode of FIGS. 1, 4 and 6, the user will set the bag on the ground or other surface and tip forward so as to apply force upon the bottom surface 112. Once tipped forward the bag is inclined from the vertical. As one skilled in the art would recognize, the particular angle at which the bag rests depends on the particular components of the stand assembly. This force will cause the foot block 102 to rotate about the pivot posts 106 and to move upward and slightly inward. The upward and inward force causes the rocker "T" bar 120 to be forced upward and to rotate on the hinge pin 118, overcoming the tension force provided by the elastic cord 126 and forcing the connecting rod 98 upward. This will have the corresponding effect, previously described with respect to FIGS. 3 and 4, of pushing the "T" connector 96 upward and rotating the legs 45 outward to the stand mode.

Although the preferred embodiment 10 is illustrated as utilizing the elastic cord 126 as the means for urging the foot pivot downward to urge the storage mode as the default, there are many other ways to accomplish this. Two such are illustrated in phantom in FIG. 5.

One alternate urging means is a hinge spring 132 which may be placed on one or both of the pivot posts 106, to interface with the foot block 102 and the base block 100. The hinge spring(s) 132 will be preloaded to accomplish the same net effect as the elastic cord 126. Similarly, a flat plate spring 133 may be secured to both the foot block 102 and the base block 100. These show only three of the various possible ways of biasing the system into the carry mode, with the biasing force being readily overcome by the force of the weight of the bag 14 and the associated clubs when it is tipped forward to achieve transition to the stand mode.

A deluxe front buttress subassembly 36 is illustrated in a perspective view in FIG. 8. This buttress subassembly 36 is intended for use in original manufacture of specialized bags adapted to receive the stand assembly 14, while the structure illustrated in the earlier figures is suited for retrofitting, as well as complete construction. The buttress subassembly 36 provides superior strength and multidimensional support to the "V" block 60 so as to provide excellent stability to the overall system 10.

The deluxe front buttress subassembly 36 includes a first longitudinal support rod 134 and a second longitudinal support rod 136, arrayed parallel to and circumferentially displaced from the first support rod 134. The support rods 134 and 136 are adapted to extend between the collar member 20 and the base member 16 and to be secured thereto at the ends. The support rods 134 and 136 are substantially identical reasonably rigid members formed of a lightweight structural metal such as aluminum, or a suitable substitute material such as fiberglass. The support rods 134 and 136 are positioned to extend along the circumference of the bag tube portion 18 equally offset from an imaginary front center line. In the preferred embodiment, each of the support rods 134 and 136 is positioned about twenty five degrees of arc from center.

An upper arc yoke 138, a central arc yoke 140 and a lower arc yoke 142 extend between the support rods 134 and 136. These curved yoke members follow the exterior contour of the bag shape and provide separation and registration to the support rods 134 and 136. The arc yokes 138, 140 and 142 are separated longitudinally along the support rods 134 and 36 and are held in position by slide locks 144, which prevent axial sliding. The upper arc yoke 138 is adapted to lie just below the collar member 20 and provides a location at which the buttress subassembly 36 is secured to the fabric of the bag tube portion 18. The central arc yoke 140 provides the support for the top pivot subassembly 40 and the lower arc yoke 142 is situated baseward from the central arc yoke 140 by approximately 22 cm (8.7 in.).

Each arc yoke 138, 140 and 142 is formed to include a pair of end cylinder portions 146 and an arced bar portion 48 extending therebetween. The end cylinders are adapted to slidably receive the support rods 134 and 136 and to further receive the slide lock members 144 to lock them in axial position. The arced bar portions 148 are structurally rigid support members which include a bracket portion 150 in the center, the bracket portions 150 of the arc yokes 138, 140 and 142 being aligned along the front of the bag. The bracket portions 150 each include a central aperture 151 which permits attachment of different components, depending on the particular one of the arc yokes 138, 140 and 142 involved. The bracket portion 150 of the upper arc yoke 138 is adapted to receive a securing fastener 152, such as a rivet, to attach the yoke 138 to the bag tube portion 18. The bracket portion 150' associated with the central arc yoke 140 protrudes further than the others and is adapted to fit into a receiving detent 154 which is formed in the rear surface of the "V" block 60 and a acorn nut type screw fastener 152 secures the "V": block 60 thereto, with the nesting of the bracket portion 150' with the receiving detent 154 preventing lateral or rotational motion. Because of molding process requirements in the formation of the central arc yoke 140. The bracket portion 150' includes a hollowed out section on the reverse side. The bracket portion 150 of the lower arc yoke 142 provides a securing anchor for attachment of a stability strap structure 156 which extends about a portion of the leg members 45 to avoid placing undue material stress on the stop ledge 88. The stability strap 156 helps to control the rotational limits of the leg members 45, both forward (away from the bag) and laterally outward (spread apart). Redundant support structures such as this increase the durability and stable "feel" of the system When the deluxe front buttress subassembly 36 is utilized, the bag is not as "soft-sided" in a strict sense as in the other configuration, but since the rigid support rods 134 and 136 axially coincide with the rigid leg members 45, the difference is not noticeable to the user. The increased stability is substantial, however.

One feature of the present invention which distinguishes it from many of the prior art structures is the relative proximity of the stand activation mechanisms to the original bag assembly 12. This, combined with the relatively small axial travel distance of the connecting rod subassembly 42, makes it feasible to enclose a substantial portion of the stand assembly 14. This may be desirable for esthetic purposes or to protect the mechanisms from outside interference or contamination.

In the illustration of FIG. 2, it may be seen that a protective sheath 158 is provided to enclose the top pivot assembly 40 and majority of the connecting rod subassembly 42, with appropriate access being provided for the leg members 45 to the 37 V" block 60. This protective sheath 158, or a corresponding extension of the bag tube portion 18, itself, can be releasably held in place by snaps, zippers or the like to hide the top pivot subassembly 40 from view and to minimize the access of dirt, clothing items and the like to the moving components. The protective sheath 158 may also add to the visual appeal.

In the preferred embodiment, the rod portion 50 of the leg members 45 and the connecting rod 98 are constructed of a high strength, light weight, hollow fiberglass tubular material or from aluminum. The "L" joints 78, the rocker arms 80, the sliding posts 92, the pivot posts 106 and the hinge pin 118 will be formed of a structural metal, such as steel or aluminum. The elastic cord 126 will be a "bungee" cord selected to have a length and tension so as to provide a degree of force which is sufficient to urge the leg members 45 into the storage mode, but being relatively easily overcome by the force of rotating the bag forward such that the foot block 102 is rotated upward. The remainder of the structural materials of the stand assembly 14 will be constructed of a durable high strength structural plastic such as Delrin TM.

The inventor has found that, with the structure shown and described herein, a relative linear travel of the connecting rod subassembly 42 from the storage mode to the stand mode of approximately 1.2 cm (0.5 inch) is optimal. This causes the legs 45 to rotate outward from the storage mode approximately 45° degrees to the stand mode, when rocker arms 80 having an effective lever arm of 1.9 cm (0.75 inch) are utilized. Also in the preferred embodiment 10 the wing portions 64 of the "V" block 60 are angled toward the bag portion 12 at an angle of approximately 25°.

The soft sided golf bag with integral stand 10 is formed when the preferred stand assembly 14 is installed on any of a variety of available bag assemblies 12. All that is necessary in a usable bag assembly 12 is to provide a firm location upon which to mount the "V" block 60, a position properly displaced from the bottom of the bag, and further to provide a secure mounting location for the base block 100. It is expected that the stand assembly 14 may be easily incorporated into the manufacturing operation for a wide variety of golf bags and may also be amenable for retrofitting on certain sorts of bags.

Those skilled in the art will readily recognize that numerous other modifications and alterations of the specific structures, dimensions, materials and components may be made without departing from the spirit and scope of the invention. Accordingly, the above disclosure is not to be considered as limiting and the appended claims are to be interpreted as encompassing the entire scope of the invention.

INDUSTRIAL APPLICABILITY

The soft sided golf bag with integral stand 10 according to the present invention is adapted to be used by a wide variety of golfers, and is particularly adapted for use by those golfers who prefer to carry their own golf bags while retaining the convenience of utilizing a bag with an integral stand mechanism such that the open end of the bag rests above the ground with good presentation of the clubs when taken off the shoulders. The stand assembly 14 of the present invention is particularly intended for use with bag assemblies 12 which are soft sided in nature and light in weight, although it is adaptable for incorporation into other varieties of bag assemblies 12.

The soft sided golf bag with integral stand 10 is constructed by attaching the inventive stand assembly 14 to a bag assembly 12. There are two points of connection between the stand assembly 14 and the bag assembly 12, these being at the position of the top pivot subassembly 40 and the foot pivot subassembly 44. The foot pivot subassembly 44 is mounted in such a manner that the base block 100 and the bottom surface 112 of the foot block 102 lie flat upon the ground or floor when the bottom of the base member 16 is sitting flat upon the floor. The top pivot subassembly 40, and particularly the "V" block 60, is then positioned so as to be located the appropriate distance from the base block 100 to facilitate proper operation of the connecting rod subassembly 42. This mounting can either be accomplished during original manufacture or by a retrofit process. The preferred structure includes the deluxe front buttress subassembly 36 (FIG. 8) for the support of the pivot subassembly 40 and a specially molded base member 16 including an integrally formed base block 100.

The inventive golf bag with integral stand 10 is utilized by the golfer to be alternately configured in either a storage mode (illustrated in FIGS. 2, 3 and 5) or a stand mode (illustrated in FIGS. 1, 4 and 6). It is expected that the bag 10 will be used in storage mode when it is being carried, when it is being placed to sit upright on a garage or locker floor or when it is utilized in a golf cart. In these utilizations, it is not desirable to have the leg members 45 extended outward unduly from the bag assembly 12. However, when on the golf course and taken off the shoulder, it is expected that the bag will be utilized in the stand mode. This results in the bag being angled forward and supported by the foot pivot subassembly 44 and the leg members 45, with the handle 32 and carrying strap presented on the upper surface of the bag assembly 12 and with the golf clubs extending from the collar member 20 at an angle for easy selection, removal and replacement.

The force of the elastic cord 126 acts to pull the connecting rod 98 downward to maintain the stand assembly 14 in storage mode at all times where force is not applied to the bottom of the foot block 102. However, when the bag is taken off the shoulder, the base member 16 is placed upon the ground, and the bag is tipped forward such that the foot block 102 is caused to rotate upward, the force of the elastic cord 126 is overcome and the connecting rod 98 is forced upward so as to cause the leg members 45 to rotate outward into the stand mode orientation. Ordinarily, the weight of the golf clubs which are contained in the bag will make the simple expedient of leaning the bag forward cause sufficient force on the foot block 102 to overcome the elastic cord 126.

When the golfer then picks the bag back up by the carrying strap 30 or the handle 32, the upward force on the bottom surface 112 is removed and the force of the elastic cord 126 will again be paramount. This will cause the leg members 45 to be retracted into the storage mode for carrying.

The various components of the stand assembly 14 are adapted to be modularly and easily removed and replaced in the event of breakage. The two completely stationary members, the "V" block 60 and the base block 100, are of solid construction and formed of high durability materials and are intended to be permanently affixed to the bag assembly The remaining members are all configured and constructed so as to be easily replaceable, if needed. In particular, the component most subject to fatigue, the elastic cord 126, is adapted for easily replacement by removing the anchor nut 128 from the threaded bore 130. In this manner a replacement elastic cord 126 may be easily installed.

The adaptability and portability of the soft sided golf bag with integral stand 10 will be very desirable to a great number of golfers. This will allow golfers to utilize a single bag and a single set of clubs in a variety of use circumstances. The adaptability for use with a soft sided golf bag assembly 12 allows the purist to carry the bag comfortably while still retaining the benefit of an integrated stand mechanism. The stand mechanism is characterized by the fact that it need not be operated by the hand of the user in any manner and the forces may all be applied to it by remote actuation, such as by forces on the collar member 20 or the handle 32.

The bag 10 is a adapted to be utilized in such a manner that the storage mode is the default position and the legs are not rotated outward, except when desired. This allows for the bag to be stored upright in a garage or locker without the legs 45 interfering. Further, the legs 45 and the foot pivot subassembly 44 may be the only portions of the stand assembly 14 which are obvious to the user. That is because the connecting rod subassembly 42 has no need to extend substantially away from the tube portion 18 and may be enclosed in the protective sheath 158, if desired. The protective sheath 158 not only hides the operative mechanism from view but also prevents interference with the operation by snagging or by debris.

Since the stand assembly 14 of the present invention is adaptable for use on a wide variety of bag assemblies 12, it is expected to appeal to a great number of golfers. Ease of use features, such as the default storage mode and the operation of the stand assembly 14 without the necessity of the golfer ever touching the stand assembly 14, are also expected to enhance the appeal. Accordingly, it is expected that the soft sided golf bag with integral stand 10 according to the present invention will have industrial applicability and commercial utility which are both widespread and long lasting.

I claim:

1. A stand assembly for use with a golf bag having an elongated tube portion, a bottom member, a top collar member, and a total length taken from the bottom member to the top collar member, comprising:

a pivot block member secured to a mounting location on an exterior front portion of the elongated tube portion of the golf bag, the mounting location being displaced from the bottom of the golf bag by a distance greater than one half of the total length of the golf bag, the pivot block having a first side and a second side;

a first leg member including a proximal end having a pivot portion and a distal tip end for resting on a surface, wherein the proximal end pivotally engages the first side of said pivot block member such that the first leg member may pivot thereabout intermediate a storage position wherein said leg member extends to a position proximate the elongated tube member and a stand position wherein the tip end is displaced outward and forward from the golf bag;

a second leg member, being a mirror image of said first leg member, adapted to engage the second side of said pivot block member and, with said first leg member and a portion of the bottom portion of the golf bag, provide tripodal support for the stand position when rotated thereto, the stand position being characterized by the golf bag being inclined from vertical at an angle of 25° to 60°;

a top pivot subassembly pivotally associated with said pivot block member, said top pivot subassembly being linked to the associated proximal pivot ends of said first leg member and said second leg member;

a bottom pivot subassembly attached to the front bottom portion of the golf bag and aligned with said pivot block member, said bottom pivot subassembly including a ground engaging member which is caused to pivot upward when the golf bag is tilted forward; and a connecting rod subassembly including a single rod interconnecting said top pivot subassembly and said bottom pivot subassembly such that upward pivoting of the ground engaging member results in corresponding upward motion of said top pivot subassembly and corresponding rotation of said leg members from the storage position to the stand position.

2. The stand assembly of claim 1 wherein said first leg member and said second leg member extend to positions such that the distal tip ends are displaced upward from the bottom of the golf bag, the distal tip ends being maintained above the ground during transition between the storage position and the stand position.

3. The stand assembly of claim 1 and further including urging means for urging said stand assembly into the storage position, which urging means may be overcome by leaning the golf bag forward.

4. The stand assembly of claim 3 wherein:

said bottom pivot assembly includes a bottom block attached to the front bottom portion of the golf bag; and the urging means includes an elastic cord member secured at its lower end to the bottom block so as to be stationary with respect to the bottom of the golf bag, and attached at its upper end to said connecting rod subassembly, the elastic cord member being in a stretched condition when said stand assembly is urged into the stand mode, and, when force on the ground engaging portion is decreased, contracting to pull downward on the connecting rod subassembly to urge said leg members into the storage mode.

5. The stand assembly of claim 3 wherein the urging means includes a hinge connecting the ground engaging portion to a bottom block of said bottom pivot subassembly and a hinge spring mounted on the hinge, said hinge spring being preloaded to urge the ground engaging portion to pivot downward, correspondingly urging said leg members into the storage mode.

6. The stand assembly of claim 3 wherein said bottom pivot subassembly includes a bottom block attached to the front block portion of the golf bag; and the urging means includes a flat spring mounted on a bottom block of the base block assembly and extending to the ground engaging member, the flat spring being preloaded to urge the ground engaging portion to pivot downward, correspondingly urging said leg members into the storage mode.

7. The stand assembly of claim 1 wherein said top pivot subassembly includes a "V" block having a pair of pivot apertures extending therefrom, pivot rod means secured to said leg members such that said leg members rotate thereabout when the pivot rods are rotated, rocker arm means, secured to the pivot rod means at a distal location from said leg members, and connecting rod interface means for causing the rocker arm means to rotate as said connecting rod is moved upward or downward.

8. The stand assembly of claim 7 wherein the connecting rod interface means includes a tee member mounted on the connecting rod, the tee member having a pair of sliding posts extending laterally opposingly therefrom, the sliding posts adapted to slidably mate with apertures formed in the rocker arm means.

9. The stand assembly of claim 7 wherein the rocker arm means and the pivot rod means are integrally formed with a rocker arm being formed at the distal end of each pivot rod to extend perpendicular to the axis of rotation thereof.

10. A quick action stand assembly for use with a golf bag, the golf bag having an elongated a tube portion, a base member and a collar member, the stand assembly comprising:

a leg member subassembly including two leg members having upper and lower ends;

a top pivot subassembly including a V block member secured to a front side of the tube portion at a location nearer the collar member than the base member, and leg pivoting means attached to the top ends of the leg members for pivotally rotating the leg members intermediate a storage mode wherein the leg members extend generally parallel to the tube portion and adjacent thereto, and a stand mode wherein the lower ends of the leg members are rotated radially outward from the tube portion so as to form, with a portion of the base member, a tripodal support for the golf bag on a resting surface;

a bottom pivot subassembly, situated at the front of the base member radially intermediate the leg members, including a pivot foot member, having a bottom surface which extends forward and which is caused to pivot upward by the force of the resting upon the bottom surface of the pivot member when the golf bag is tipped forward to the orientation of the stand mode; and force transfer means, including a single connecting rod extending intermediate said top pivot subassembly and said bottom pivot subassembly, for delivering the force of pivoting of the pivot foot member to the leg pivoting means so as to cause the leg pivoting means to pivot the leg members in accordance with the orientation of the foot pivot member.

11. The quick action stand assembly of claim 10 wherein in the storage mode, the lower ends of the leg members extend along the tube portion to a position above the base member.

12. The quick action stand assembly of claim 10 wherein in the storage mode, the foot pivot member extends at a slight downward angle to the lower surface of the bottom member and, when the bottom surface of the pivot member is coplanar with the lower surface of the golf bag, the leg members are caused to be rotated to an intermediate position, between the storage mode and the stand mode.

13. The quick action stand assembly of claim 10 and further including biasing means to continually urge the stand assembly to the storage mode, the urging force provided by the biasing means being overcomable by tipping the bag forward on the resting surface.

14. The quick action stand assembly of claim 13 and further including front buttress means secured to the base member and the collar member and extending therebetween for providing firm positional support to said top pivot subassembly, the front buttress means including a pair of elongated support rods and circumferential yoke means connecting the support rods, the circumferential yoke means including an attachment location for interfacing with the V-block members and the biasing means includes spring means anchored at one end to the golf bag and attached at the other end to the foot pivot member.

15. The quick action stand assembly of claim 13 wherein said force transfer means include, in addition to the connecting rod, foot/rod interface means for pivotally attach the connecting rod to the foot pivot member and top/rod interface means for pivotally attaching the connecting rod to the leg pivoting means, and the biasing means includes spring means anchored at one end to the golf bag and attached at the other end to the connecting rod.

16. The quick action stand assembly of claim 10 wherein:

the V block member of said top pivot assembly includes two wing bores therethrough, each wing bore having a leg opening and an inside opening; and each leg pivoting means includes a pivot connector secured to each leg member, each pivot connector having a pivot post portion extending perpendicularly to the leg member at a location proximate the top end of the leg member, each pivot post portion extending through one wing bore with each leg members facing the leg opening in, such that the pivot post may rotate within the wing bore, the pivot connector interfacing with said force transfer means opposite the inside opening of the wing bore.

17. The quick action stand assembly of claim 16 wherein said top pivot assembly includes a pair of the pivot connectors, each including a rocker arm portion secured at an L joint at one end to the pivot post portion and being slidably attached at the opposing end to a sliding post on a T member, the T member interfacing with and said force transfer subassembly.

18. In a golf bag having a tube portion with a tube front and a tube rear, and a pair of leg members which may be oriented in at least a storage mode with the leg members adjacent to the bag portion and a stand mode wherein the legs and the bag portion form an inclined tripod, the improvement comprising:

providing a top pivot assembly for attaching the leg members to the bag portion, the top pivot assembly being situated in the upper longitudinal portion of the tube on the circumference thereof, providing a bottom pivot assembly attached to the tube front so as to be longitudinally aligned with said top pivot assembly, said bottom pivot assembly including a ground engaging foot pivot which is driven in a upward direction as the tube portion is tipped forward; and providing a connecting rod assembly extending intermediate said top pivot assembly and said bottom pivot assembly, said connecting rod assembly including a linear connecting rod member terminating in upper and lower tee members for respectively interfacing in a pivotal manner with said top pivot assembly and said bottom pivot assembly;

wherein the leg members are connected to the said top pivot assembly at a single force transfer point each, the single force transfer point being situated within the upper ten percent of the longitudinal extent of the leg member.

19. The improvement of claim 18 wherein a pivot connector is provided to attach to each associated leg member at the force transfer point, the pivot connector including a pivot post portion which is held in position by said top pivot assembly so as to permit limited rotation about an associated pivot axis, and a rocker arm portion interfacing with the upper tee member so as to rotate the associated leg member dependent upon the longitudinal movement of the linear connecting rod.

20. The improvement of claim 18 wherein urging means are provided to interconnect said bottom pivot assembly and said connecting rod assembly so as to urge the linear connecting rod to a position wherein the leg members are oriented in the storage mode.

* * * * *